United States Patent [19]

Takashima et al.

[11] Patent Number: 4,728,251

[45] Date of Patent: Mar. 1, 1988

[54] COMPLETE SWIVEL TYPE BACKHOE VEHICLE

[75] Inventors: Akira Takashima, Sakai; Takafumi Wada, Kaizuka, both of Japan

[73] Assignee: Kubota, Ltd., Osaka, Japan

[21] Appl. No.: 15,832

[22] Filed: Feb. 18, 1987

[30] Foreign Application Priority Data

Feb. 28, 1986 [JP] Japan ..... 61-45090

[51] Int. Cl.[4] ..... E02F 3/28

[52] U.S. Cl. ..... 414/694; 414/695.5

[58] Field of Search ..... 414/694, 695.5, 685, 414/687

[56] References Cited

U.S. PATENT DOCUMENTS 4,044,610 8/1977 Oldaeus et al. ..... 414/694 X 4,571,147 2/1986 Schaeff ..... 414/694

*Primary Examiner*—Frank E. Werner

*Assistant Examiner*—Donald W. Underwood

*Attorney, Agent, or Firm*—Jordan and Hamburg

[57] ABSTRACT

A backhoe vehicle comprising an upper carriage including a driver's section and swivellable 360 degrees on a chassis, and an excavating assembly including a boom, a bucket arm and a bucket. The boom defines a first and a second bent portions so that a distal end of the boom is inclined in a direction in which the boom is lowered. An excavating assembly holder is attached to a front region of the upper carriage and adjacent a transversely mid-position of the vehicle to be pivotable on a vertical axis. The boom is connected to the holder to be pivotable on a horizontal rotary shaft. A boom cylinder for causing pivotal movements of the excavating assembly is connected at one end to the boom and at the other end selectively to a first and a second pivot members defined on the holder. The second pivot member is disposed at a lower rearward position with respect to the first pivot member. The first bent portion is defined substantially at a longitudinally mid-position of the boom, and the second bent portion is defined between the first bent portion and the rotary shaft. A distance between the rotary shaft and the second bent portion is substantially equal to a distance between the rotary shaft and the first pivot member.

5 Claims, 4 Drawing Figures

COMPLETE SWIVEL TYPE BACKHOE VEHICLE

BACKGROUND OF THE INVENTION

The present invention relates to a complete swivel type backhoe vehicle or excavator comprising a chassis including right and left traveling devices, an upper carriage swivellable 360 degrees on the chassis and an excavating assembly attached to the upper carriage to be pivotable on a vertical axis, wherein the excavating assembly in a contained position is located in a locus circle described by an outer contour of the upper carriage.

A conventional backhoe vehicle of this type is known, for example, from European patent laying-open publication No. 0 131 939 A1. The backhoe vehicle disclosed in this publication has an excavating assembly holder located at a laterally displaced position on the front end of the upper carriage. The excavating assembly as folded up is erected to a limit and is brought close to a swivel axis of the upper carriage by pivoting the excavating assembly until a side face of the bucket lies close to a front end of the driver's section. This operation permits the excavating assembly to lie within a locus circle described by an outer contour of the upper carriage.

However, the foldup position of the excavating assembly as described above allows only a very limited range of choice for positioning of a pivotal connection between the excavating assembly holder and a cylinder for raising and lowering the boom. More particularly, where the position of the pivotal connection between the excavating assembly holder and the boom raising and lowering cylinder is selected in order to be capable of digging a deepest possible trench with a given excavating assembly, the excavating assembly does not come close enough to the vehicle even when the boom is raised to a limit. This is inconvenient for swivelling purposes.

In order to solve this problem, two pivotal connections may be provided for the excavating assembly holder and the boom raising and lowering cylinder, one of the connections being at a position to permit the excavating assembly to approach the swivel axis of the upper carriage as much as possible and the other connection at a position suited for deep excavation. This modification, however, has the following disadvantage.

It is necessary for the boom to have a good degree of bend at its bent portion in order to achieve a great digging depth. However, when the boom is raised, the back of such a bent portion protrudes into a space in the driver's section as shown in a phantom line in FIG. 1 of the accompanying drawings. This not only reduces the accommodating space for the driver but is dangerous to the driver. Therefore, the above modification is satisfactory to a limited degree only.

SUMMARY OF THE INVENTION

The object of the present invention is to provide a backhoe vehicle which displays a high degree of efficiency and is capable of deep excavation in a narrow site. The backhoe vehicle proposed by this invention is capable of excavating trenches or the like to a great depth, and at the same time is free from the inconvenience of the back of the bent portion of the boom protruding into the space of the driver's section when the boom is raised or erected to bring the excavating assembly close to the swivel axis of the upper carriage.

In order to achieve the above object, an backhoe vehicle according to the present invention comprises a chassis including traveling devices on lateral sides thereof, an upper carriage including a driver's section on a front portion thereof and swivellable 360 degrees on the chassis, an excavating assembly including a boom, a bucket arm and a bucket, the boom defining a first bent portion and a second bent portion so that a distal end of the boom is inclined in a direction in which the boom is lowered, an excavating assembly holder attached to a front region of the upper carriage and adjacent a transversely mid-position of the vehicle to be pivotable on a vertical axis, the boom being connected to the holder to be pivotable on a horizontal rotary shaft, and a boom cylinder for causing pivotal movements of the excavating assembly, the boom cylinder being connected at one end to the boom and at the other end selectively to one of a first pivot member and a second pivot member defined on the holder, the second pivot member being disposed at a lower rearward position with respect to the first pivot member, wherein the first bent portion is defined substantially at a longitudinally mid-position of the boom, and the second bent portion is defined between the first bent portion and the rotary shaft, a distance between the rotary shaft and the second bent portion being substantially equal to a distance between the rotary shaft and the first pivot member.

The above construction permits the boom to move close to the swivel axis of the upper carriage by connecting the boom cylinder to the first pivot member, and to be lowered to a position for deep excavation by connecting the boom cylinder to the second pivot member. Since the boom defines the second bent portion in addition to the first bent portion, the protrusion of the back of the first bent portion into the space of the driver's section when the excavating assembly is erected is diminished without affecting the excavating depth. Moreover, the position of the second bent portion is determined such that the first pivot member does not interfere with the boom when the boom is lowered with the boom cylinder connected to the second pivot member to excavate deep trenches or the like.

Thus, the backhoe vehicle according to the present invention is capable of deep excavation and of efficient excavation work involving swivelling movements in a narrow site.

Other features and advantages of the invention will be apparent from the following description of the preferred embodiment.

BRIEF DESCRIPTION OF THE DRAWINGS

The drawings illustrate a complete swivel type backhoe vehicle embodying the present invention, in which.

DESCRIPTION OF THE PREFERRED EMBODIMENT

Figure 1:
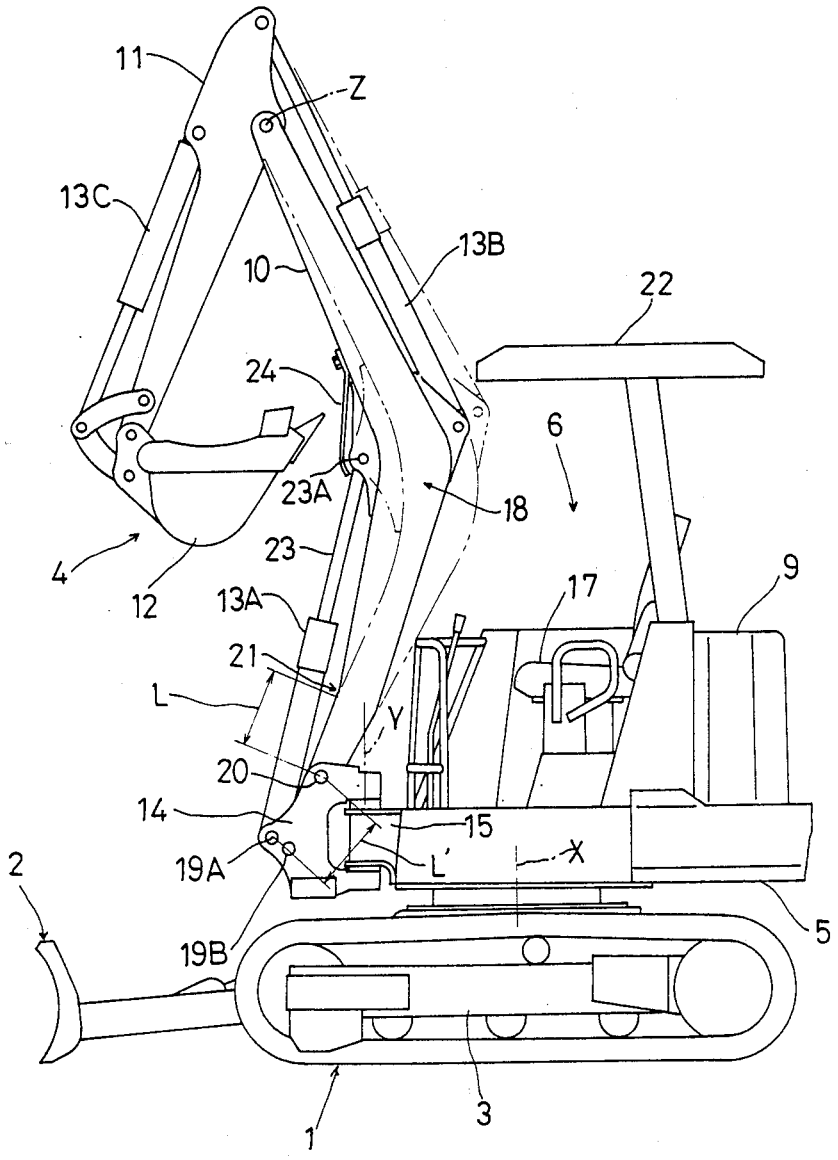
FIG. 1 is a side elevation of the backhoe vehicle wherein a boom cylinder is connected to a first pivot member.
Figure 2:
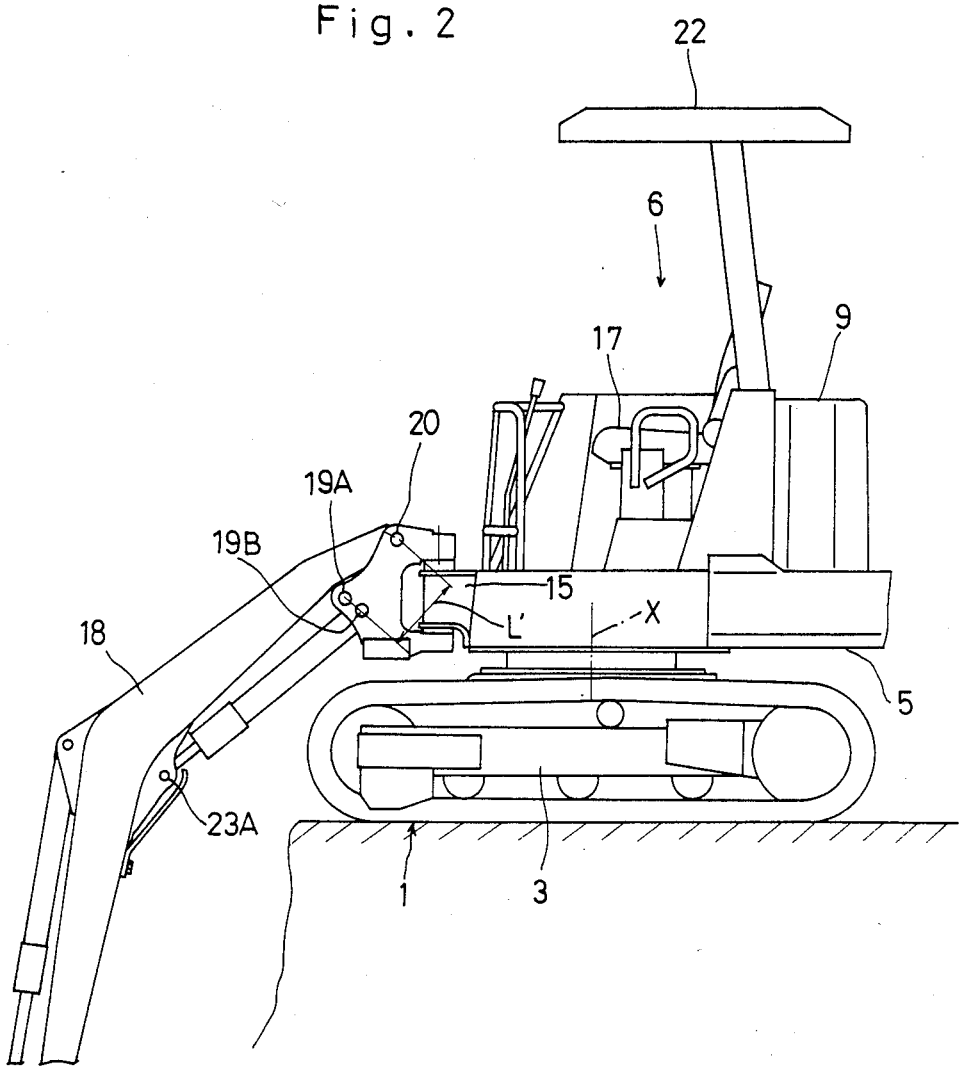
FIG. 2 is another side elevation of the backhoe vehicle wherein the boom cylinder is connected to a second pivot member.
Figure 3:
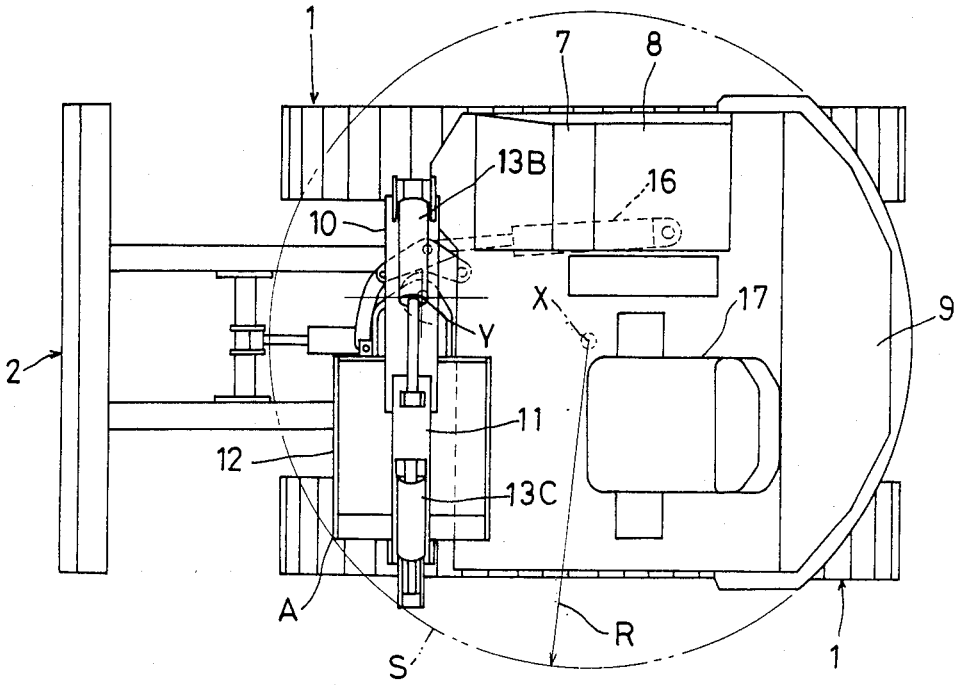
FIG. 3 is a plan view of the vehicle wherein an excavating assembly lies adjacent a driver's section.

As shown in FIGS. 1 through 3, a backhoe vehicle according to the present invention basically comprises a pair of right and left crawler traveling devices 1 and an earth-moving implement 2 attached to a chassis 3. The chassis 3 supports an upper carriage 5 carrying an excavating assembly 4, the upper carriage 5 being swivellable completely or 360 degrees about a swivel axis X.

The upper carriage 5 further carries a driver's section 6 on a forward portion and one lateral side thereof, a fuel tank 7 and a pressure oil tank 8 on the other lateral side, and a motor section 9 covered by a bonnet on a rear portion.

As is well known, the excavating assembly 4 comprises a boom 10, an arm 11 and a bucket 12 pivotally connected in series and driven respectively by hydraulic cylinders, namely a boom cylinder 13A, an arm cylinder 13B and a bucket cylinder 13C, to flex and move up and down. The boom 10 is pivotally supported at a lower end thereof by an excavating assembly holder 14 which in turn is supported by a front end bracket 15 of the upper carriage 5 to be pivotable on a vertical axis Y by the action of a hydraulic cylinder 16. The vertical axis Y is located adjacent the center of the vehicle as viewed from the front of the upper carriage 5. Through the pivoting movement of the assembly holder 14, the excavating assembly 4 is movable between a position facing forwardly and a position approximately at right angles to the driver's section 6.

The boom 10 defines a first bent portion 18 at a substantially mid-position of its length so that a distal end thereof is inclined in the direction in which the boom 10 is lowered. The arm 11 is substantially equal in length to a portion of the boom 10 above the first bent portion 18. The excavating assembly 4 assumes a first position in which the excavating assembly 4 is pivoted sideways about 90 degrees toward the driver's section, the boom 10 is erected to a limit, the arm 11 is flexed to a limit, and the bucket 12 is pivoted inwardly to a substantially horizontal posture. In this first position, when viewed from the front of the vehicle, a pivotal point Z between the boom 10 and arm 11 is located on or adjacent the swivel axis X, the portion of the boom 10 above the first bent portion 18 and the arm 11 define the two legs of an equilateral triangle with the pivotal point Z between the boom 10 and arm 11 defining its vertex, and the bucket 12 has an extreme end thereof located sufficiently close to an inner side of the first bent portion 18 of the boom 10.

In this upstanding, maximum foldup position of the excavating assembly 4, the front end of the driver's section 6 protrudes into an area below the bucket 12. The upper carriage 5 has such a rear contour that, in the swivelling movement, follows a circle S described in plan view by an outer position A at a base or attachment end of the bucket 12 which constitutes an outermost part of the excavating assembly 4 in the above-noted position. In other words, the excavating assembly 4 is located inside the circle S described by the rear of the upper carriage 5 in the swivelling movement. FIG. 1 shows a second position of the excavating assembly 4 in which the boom 10 is erected to the limit, the arm 11 is flexed, and the bucket has its extreme end opposed to the driver's section 6. In this second position, the pivotal point Z is located substantially over front ends of the traveling devices 1 in side view of the vehicle. When the driver's section 6 faces forwardly, the upper carriage 5 substantially does not project from the traveling devices 1 in plan view. The driver's section 6 includes a driver's seat 17 disposed centrally thereof, and a sunshade 22 covering an area over the driver's seat 17.

The excavating assembly holder 14 defines a first pivot member 19A and a second pivot member 19B for connection to the boom cylinder 13A, the second pivot member 19B being disposed at a lower rearward position with respect to the first pivot member 19A, so that an end of the boom cylinder 13A may be attached to the two alternative positions. More particularly, the boom cylinder 13A is attached to the second, lower rearward pivot member 19B when digging deep trenches or the like as shown in FIG. 2, and to the first, upper forward pivot member 19B as shown in FIG. 1 to provide the bucket 12 with an increased upper limit for its movement and minimize the radius of swivelling for convenience of operations in a narrow site.

The first bent portion 18 of the boom 10 has a smaller bend than the bent portion of the conventional boom 10 (indicated in phantom lines in FIG. 1). The boom 10 defines a second bent portion 21 between the first bent portion 18 and an attachment portion or rotary shaft 20 connected to the assembly holder 14 so that the upper portion of boom 10 including the bent portion 18 is inclined in the direction in which the boom 10 is lowered. The second bent portion 21 is located such that a distance L between the rotary shaft 20 and the second bent portion 21 is substantially equal to a distance L' between the rotary shaft 20 and the first pivot member 19A. In other words, the position and bending degree of the second bent portion 21 are determined such that the first pivot member 19A does not interfere with the boom 10 when the boom 10 is lowered to a limit with the boom cylinder 13A connected to the second pivot member 19B, and that the boom 10 does not interfere with the region of driver's section 6 when the boom 10 is raised to a limit with the boom cylinder 13A connected to the first pivot member 19A.

Figure 4:
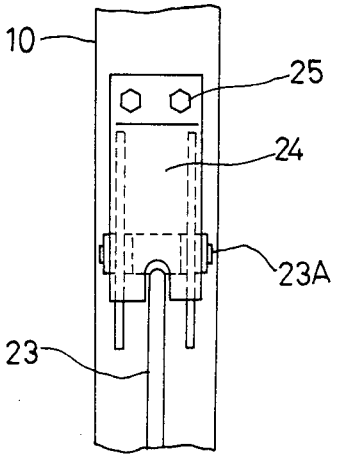
FIG. 4 is an enlarged view of a connection between the boom cylinder and a boom.

As shown in FIGS. 1, 2 and 4, a cover 24 is attached to the boom 10 adjacent the first bent portion 18 by means of bolts 25. This provision is for protecting a pivotal portion 23A for supporting a piston rod 23 constituting an end of the boom cylinder 13A from earth spilling out of the bucket 12 and adhering to the pivotal portion 23A when the boom 10 is raised with the bucket 12 containing the earth dug from the ground.

What is claimed is:

1. A backhoe vehicle comprising;

a chassis (3) including traveling devices (1) on lateral sides thereof, an upper carriage (5) including a driver's section (6) on a front portion thereof and swivellable 360 degrees on said chassis (3), an excavating assembly (4) including a boom (10), a bucket arm (11) and a bucket (12), said boom (10) defining a first bent portion (18) and a second bent portion (21) so that a distal end of said boom (10) is inclined in a direction in which said boom (10) is lowered, an excavating assembly holder (14) attached to a front region of said upper carriage (5) and adjacent a transversely mid-position of the vehicle to be pivotable on a vertical axis (Y), said boom (10) being connected to said holder (14) to be pivotable on a horizontal rotary shaft (20), and a boom cylinder (13A) for causing pivotal movements of said excavating assembly (4), said boom cylinder (13A) being connected at one end to said boom (10) and at the other end selectively to one of a first pivot member (19A) and a second pivot member (19B) defined on said holder (14), said second pivot member (19B) being disposed at a lower rearward position with respect to said first pivot member (19A), wherein said first bent portion (18) is defined substantially at a longitudinally mid-position of said boom (10), and said second bent portion (21) is defined between said first bent portion (18) and said rotary shaft (20), a distance between said rotary shaft (20) and said second bent portion (21) being substantially equal to a distance between said rotary shaft and said first pivot member (19A).

2. A backhoe vehicle as claimed in claim 1 wherein a bending degree of said second bent portion (21) is determined such that said first pivot member (19A) does not interfere with said boom (10) when said boom (10) is lowered to a limit with said boom cylinder (13A) connected to said second pivot member (19B), and that said boom (10) does not interfere with a region of said driver's section (6) when said boom (10) is raised to a limit with said boom cylinder (13A) connected to said first pivot member (19A).

3. A backhoe vehicle as claimed in claim 2 wherein said upper carriage (5) substantially does not project from said traveling devices (1) in plan view when said driver's section (6) faces forwardly.

4. A backhoe vehicle as claimed in claim 3 wherein said excavating assembly (4) in a foldup position lies substantially within a circle (S) described by a rear end of said upper carriage (5) in a swivelling movement when said boom (10) is raised to the limit and said excavating assembly (4) is pivoted sideways on said vertical axis (Y).

5. A backhoe vehicle as claimed in claim 4 wherein an arm support axis (Z) interconnecting said boom (10) and said arm (11) lies substantially over front ends of said traveling devices (1) when said excavating assembly (4) is folded up and said boom (10) is raised to the limit with said boom cylinder (13A) connected to said first pivot member (19A).

* * * * *